US011559126B1

(12) United States Patent
Samangooie

(10) Patent No.: US 11,559,126 B1
(45) Date of Patent: Jan. 24, 2023

(54) APPLICATOR FOR A CONTAINER

(71) Applicant: CaseMed Engineering, LLC, Wadsworth, IL (US)

(72) Inventor: Casey Samangooie, Wadsworth, IL (US)

(73) Assignee: CASEMED ENGINEERING, LLC, Wadsworth, IL (US)

( * ) Notice: Subject to any disclaimer, the term of this patent is extended or adjusted under 35 U.S.C. 154(b) by 0 days.

(21) Appl. No.: 17/830,966

(22) Filed: Jun. 2, 2022

(51) Int. Cl.
*A45D 34/04* (2006.01)
*A45D 40/26* (2006.01)

(52) U.S. Cl.
CPC ..... *A45D 34/04* (2013.01); *A45D 40/26* (2013.01); *A45D 2200/1018* (2013.01)

(58) Field of Classification Search
CPC ..... A45D 34/04; A45D 2200/1018; A45D 40/26; A45D 2200/1009; A45D 2200/1027; A45D 34/00
USPC ..... 401/205–207, 291
See application file for complete search history.

(56) References Cited

U.S. PATENT DOCUMENTS 2,185,575 A 1/1940 Stinson et al.
2,742,660 A * 4/1956 Esley ..... A47L 13/312 401/207
2,924,837 A * 2/1960 Lehre ..... B43M 11/06 401/207
4,526,294 A 7/1985 Hirschmann et al.
4,889,441 A * 12/1989 Tice ..... A45D 34/042 D28/7
6,045,279 A * 4/2000 Follis ..... A45D 34/04 401/6
6,688,795 B1 2/2004 Jacob et al.
6,840,694 B2 1/2005 Gueret
7,114,871 B2 * 10/2006 Thiebaut ..... A45D 34/042 401/205
10,918,187 B2 2/2021 Pires et al.
2004/0047674 A1 * 3/2004 Geardino ..... B05C 17/002 401/196
2006/0045609 A1 * 3/2006 McAuley ..... A45D 34/04 401/206
2007/0267080 A1 * 11/2007 Babel ..... A45D 34/045 137/800
2008/0163887 A1 7/2008 Gieux

OTHER PUBLICATIONS

Notification of Transmittal of the International Search Report and the Written Opinion of the International Searc Hing Authority, or the Declaration, PCT/US2022/031994, International Filing date Jun. 2, 2022, dated Sep. 1, 2022.

* cited by examiner

*Primary Examiner* — David J Walczak
(74) *Attorney, Agent, or Firm* — Flener IP & Business Law; Zareefa B. Flener

(57) ABSTRACT

An applicator for a container includes a support structure, which includes a first end having a convex surface, one or more lateral surfaces extending away from the first end, a second end opposite to the first end and having an opening into an internal cavity, and one or more longitudinal passages providing fluid communication between the first end and the internal cavity. The support structure is adapted to detachably attach to a container at the second end and is further adapted to detachably attach an applicator pad to the convex surface.

20 Claims, 15 Drawing Sheets

APPLICATOR FOR A CONTAINER

FIELD OF THE INVENTION

The present invention relates to an applicator for a container. In particular the present invention relates to an applicator having a disposable applicator pad installed over a convex surface of a support structure and a user selectable delivery valve disposed on the support structure, wherein the support structure can be attached to a container for dispensing the contents therein through the applicator.

BACKGROUND

Containers for creams, lotions, gels, powders, and any other flowable materials, for example without limitation, cosmetic and medical products are often sold and stored in containers from which the contents are accessed by a user. For example, such containers include without limitation bottles, airless bottles, droppers, jars, collapsible tubes, deodorant containers, lip gloss containers, beauty sticks, lipsticks, compacts, palettes, pumps, and sprayers. Such containers can have a volume that holds may applications of the product stored therein, and consequently the contents can potentially be used by multiple users leading to cross-contamination concerns. The contents of the container could also be industrial or cleaning products such as cleaning fluids, oils, greases, corrosive fluids, and the like. Regardless of the kind of container or the contents therein, the contents are accessed through an opening into the container. A need exists for a simple, economical, and disposable applicator that can be applied over the opening of any sort of container, wherein the applicator can be discarded after each use to provide a sanitary unused applicator surface for each successive user. Further, such containers often leak when carried for travel, for example, when exposed to lowered pressure within an aircraft or be being crushed within luggage. A further need therefore exists for the applicator to include a user selectable dispensing valve that provides a seal against leakage when not selected for use.

BRIEF SUMMARY OF THE INVENTION

In one aspect of the invention, an applicator for a container comprises a support structure, which comprises a first end having a convex surface, one or more lateral surfaces extending away from the first end, a second end opposite to the first end and having an opening into an internal cavity, and one or more longitudinal passages providing fluid communication between the first end and the internal cavity. The support structure is adapted to detachably attach to a container at the second end and is further adapted to detachably attach an applicator pad to the convex surface.

In another aspect of the invention, an applicator for a container comprises an applicator pad and a support structure, which comprises a first end having a convex surface, one or more lateral surfaces extending away from the first end, a second end opposite to the first end and having an opening into an internal cavity, and one or more longitudinal passages providing fluid communication between the first end and the internal cavity. The support structure is adapted to detachably attach to a container at the second end and is further adapted to detachably attach an applicator pad to the convex surface.

In a further aspect of the invention, an applicator for a container comprises an applicator pad and a support structure, which comprises a first end having a convex surface, one or more lateral surfaces extending away from the first end, a second end opposite to the first end and having an opening into an internal cavity, and one or more longitudinal passages providing fluid communication between the first end and the internal cavity. The support structure is adapted to detachably attach to a container at the second end and is further adapted to detachably attach an applicator pad to the convex surface. The applicator further comprises one or more user selectable valves disposed across the one or more longitudinal passages, wherein each of the one or more user selectable valves has a closed and sealed configuration and an open configuration.

In an embodiment a valve tube is disposed through one of the one or more lateral surfaces, the valve tube intersecting the longitudinal passage and having a longitudinal cross-section that extends laterally beyond the longitudinal passage. In an embodiment a valve having a valve shaft is disposed within the valve tube, the valve shaft connected to an actuator portion that extends outside of the valve tube beyond the one or more lateral surfaces. In various embodiments, the valve has an open configuration allowing fluid communication through the longitudinal passage and a closed configuration blocking fluid communication through the longitudinal passage.

DETAILED DESCRIPTION

The following detailed embodiments presented herein are for illustrative purposes. That is, these detailed embodiments are intended to be exemplary of the present invention for the purposes of providing and aiding a person skilled in the pertinent art to readily understand how to make and use of the present invention. While certain shapes and materials are used in some embodiments, they are by no means an intention of restriction. Specific materials for embodiments that can be utilized for any portion or component of or for all of the applicator include, for example without limitation, polyethylene terephthalate (PET), high-density polyethylene (HDPE), polyvinyl chloride (PVC), low-density polyethylene (LDPE), polypropylene (PP), polystyrene, miscellaneous plastics such as polycarbonate, polyactide, acrylic, acrylonitrile butadiene, styrene, fiberglass, and nylon, Other materials that can be utilized for any portion or component of or for all of the applicator include, for example without limitation, aluminum, stainless steel, or acrylonitrile butadiene styrene (ABS) In an embodiment, any or all of the components of the applicator can be made, for example without limitation, by injection molding. Parts made of aluminum or stainless steel could also be made by molding, casting, or injection as is known in the art. In an embodiment, any or all of the components of the applicator can further be made from natural or synthetic fibers, and can be sustainable, compostable, and/or biodegradable, and can be made from or coated with anti-microbial materials.

Figure 1:
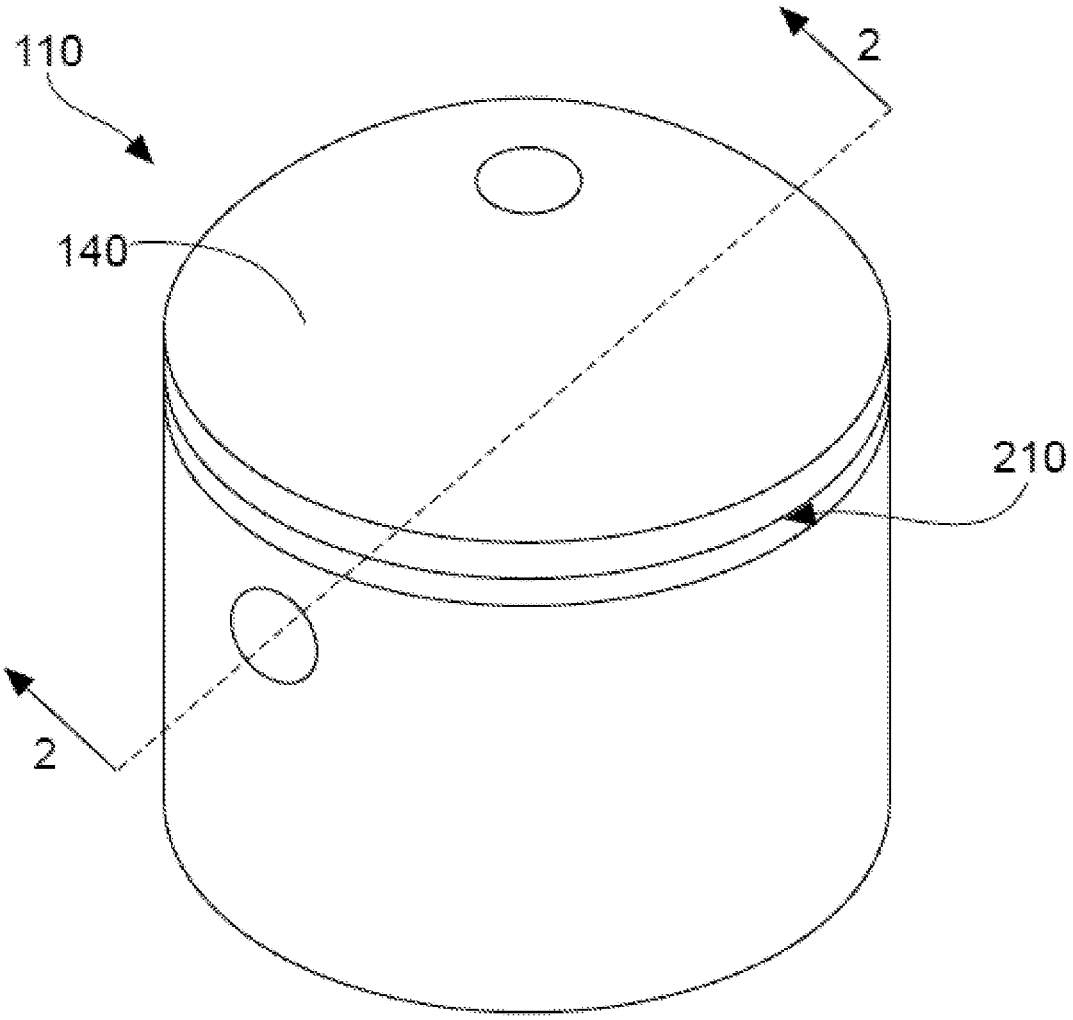
FIG. 1 is a perspective view of a support structure according to an embodiment.
Figure 2:
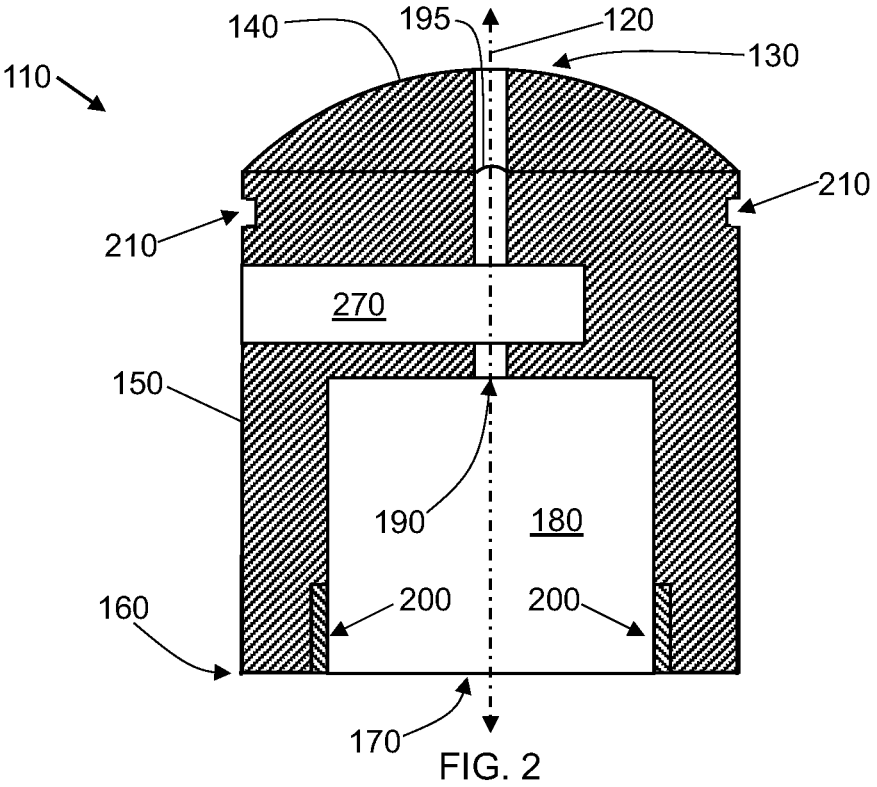
FIG. 2 is a cross-sectional view taken generally along the lines 2-2 in FIG. 1.

Referring to FIGS. 1 and 2, wherein FIG. 2 is a cross-sectional view of FIG. 1 taken generally along the lines 2-2 in FIG. 1, in an embodiment a support structure 110 is schematically illustrated as having a longitudinal axis 120. In an embodiment a first end 130 of the support structure 110 has a convex surface 140. In an embodiment one or more lateral surfaces 150 extend away from the first end 130. The support structure 110 shown in FIGS. 1 and 2 is illustrated to be cylindrical so that there is only one circumferentially extending lateral surface 150. However, the support structure 110 can have other cross-sectional shapes in other embodiments so that there can be, for example, three, four, five, six, seven, eight, nine, ten, or more lateral surfaces 150. Further, the convex surface 140 is illustrated to be smoothly curvilinear; however, in other embodiments the surface need not be smooth and can instead be bumpy or formed with an otherwise irregular surface including, for example, without limitation linear or curvilinear grooves or protuberances.

Referring to FIG. 2, in an embodiment a second end 160 opposite to the first end 130 has an opening 170 into an internal cavity 180. In an embodiment a longitudinal passage 190 provides fluid communication between the first end 130 and the internal cavity 180. In an embodiment the longitudinal passage 190 includes a one-way valve 195, for example without limitation, a flapper valve 195 or a check valve 195. The one-way valve 195 allows flow out of the support structure 110 (upwardly in FIG. 2), but prevents back flow (downwardly in FIG. 2) of the contents and also prevents external debris from getting into the internal cavity 180.

Figure 3A:
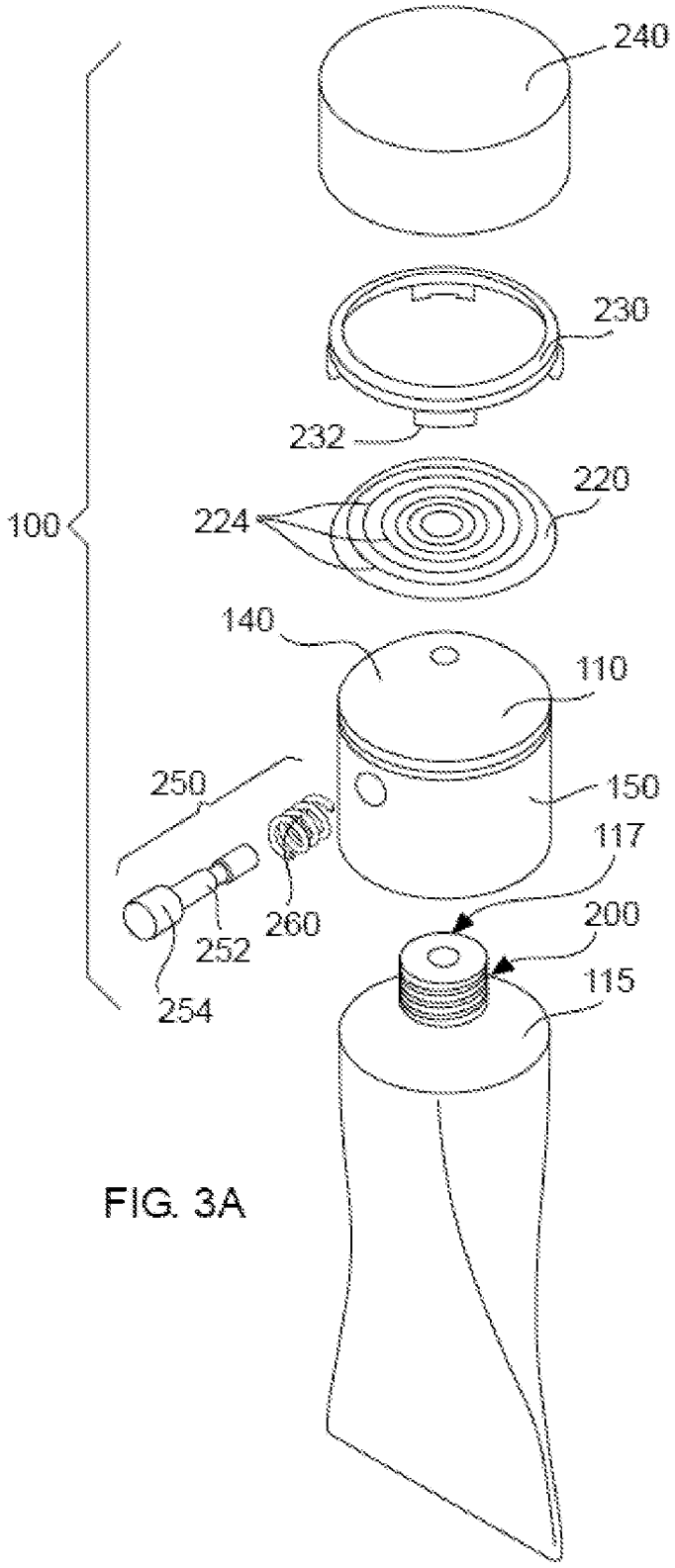
FIG. 3A is an exploded perspective view of an applicator according to an embodiment.
Figure 3B:
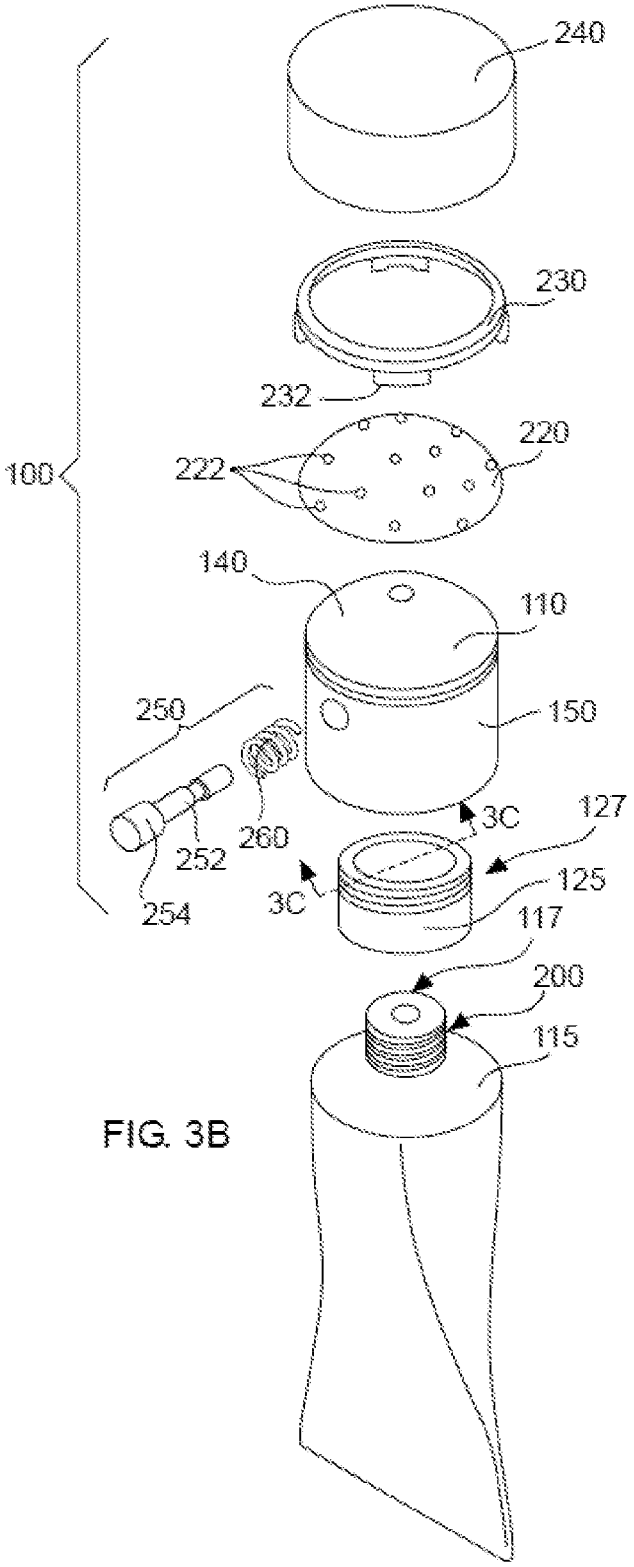
FIG. 3B is an exploded perspective view of an applicator including an adapter according to another embodiment.

FIGS. 3A and 3B illustrate two embodiments of the applicator 100 in an exploded state. A container 115 is illustrated in FIGS. 3A and 3B to be a collapsible tube; however, the container 115 can be any sort of container of any size, for example without limitation as listed in the background section above, the container 115 having an opening 117 over which the applicator 100 is detachably attachable.

In an embodiment as shown in FIG. 3A, the support structure 110 is adapted to directly attach to the container 115 at the second end 160. For example without limitation, in an embodiment threads 200 schematically illustrated in FIG. 2 cooperate with threads 200 on the container 115 to detachably attach the support structure 110 directly to the container 115. In other embodiments the support structure 110 attaches to the container 115 via a snap-fit connection including one or more recesses disposed on the support structure 110, a snap-fit connection including one or more protrusions extending from the support structure 110, a press-fit, a bayonet slot and pin (push and turn) connection, and combinations thereof, or by other mechanisms for attachment as are known in the art, wherein any of the above listed mechanisms for attachment can further include one or more sealing rings or gaskets disposed between the support structure 110 and the opening 117 of the container 115 to provide a seal therebetween. The bayonet slot and pin connection comprises an L-shaped slot with a bump or catch on one mating surface and a pin extending from the other mating surface, wherein the L-shaped slot is pushed down over the pin and rotated until the pin catches in the bump or catch. Such a bayonet slot and pin (or push and turn) connection mechanism is well known in the art and need not be described further.

Figure 3C:
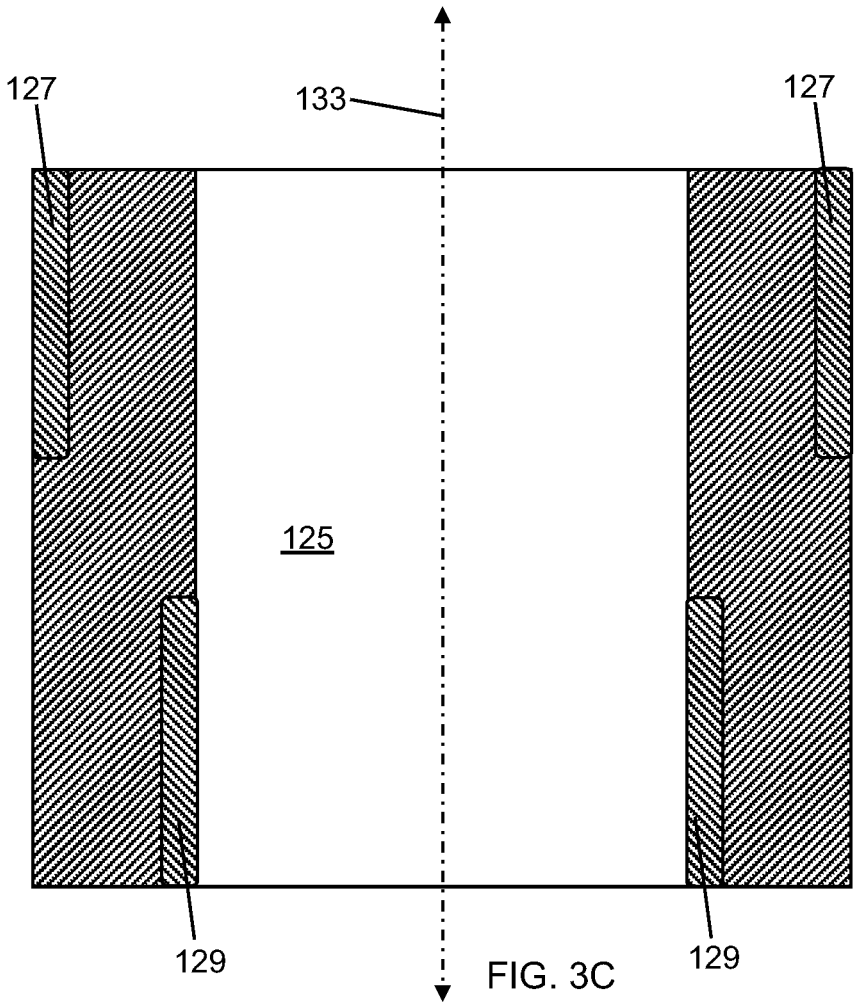
FIG. 3C is a cross-sectional view of an exemplary adapter according to an embodiment taken generally along the lines 3C-3C in FIG. 3B.

In another embodiment as shown in FIG. 3B, the support structure 110 is adapted to attach to the container 115 via an adapter 125, which is shown in cross-section in FIG. 3C having a longitudinal axis 133, which aligns with the longitudinal axis 120 when the support structure 110 is attached to the adapter 125. For example without limitation, in an embodiment threads 200 schematically illustrated on the support structure 110 in FIG. 2 cooperate with threads 127 on the adapter 125 to detachably attach the support structure 110 to the adapter 125. In turn, in an embodiment the adapter 125 includes threads 129 that detachably attach the adapter 125 to the container 115.

In other embodiments the support structure 110 attaches to the adapter 125 and the adapter 125 attaches to the container 115 via a snap-fit connection including one or more recesses disposed on the support structure 110 or the adapter 125, a snap-fit connection including one or more protrusions extending from the support structure 110 or the adapter 125, a press-fit, a bayonet slot and pin (push and turn) connection, and combinations thereof, or by other mechanisms for attachment as are known in the art, wherein any of the above listed mechanisms for attachment can further include one or more sealing rings or gaskets disposed between the support structure 110 and the adapter 125 or between the adapter 125 and the opening 117 of the container 115 to provide a seal therebetween. The adapter 125 can be sized to fit on any sized container 115. In an embodiment the adapter 125 can comprise a set of different sized adapters 125 to allow the applicator 100 to be detachably connectable to a container 115 having any sized opening 117.

Referring to FIGS. 3A and 3B, in an embodiment the support structure 110 is adapted to attach a pad holder ring 230 to the one or more lateral surfaces 150 proximate to the first end 130. For example, in an embodiment one or more recesses 210 (see FIG. 2) disposed on the one or more lateral surfaces 150 proximate to the first end 130 cooperate with complementary inwardly directed protrusions 232 that snap into the one or more recesses 210 to detachably attach the pad holder ring 230 to the support structure 110. In other embodiments the pad holder ring 230 detachably attaches to the support structure 110 via a snap-fit connection including one or more protrusions extending from the support structure, a snap-fit connection including one or more grooves extending into the support structure, a press-fit, a bayonet slot and pin (push and turn) connection, threads, and combinations thereof, or by other mechanisms for attachment as are known in the art.

Referring to FIG. 3A, an embodiment of an applicator 100 is illustrated in an exploded disassembled view including the support structure 110, an applicator pad 220, the pad holder ring 230, and a cover or cap 240 that detachably attaches to the support structure 110 over the pad holder ring 230. The cover cap 240 covers the applicator pad 220 when the applicator 100 is not in use. FIG. 3B illustrates an embodiment of an applicator 100 further comprising the adapter 125 as described hereinabove. In an embodiment the cap or cover 240 detachably attaches over the support structure 110 by a press-fit; however, in other embodiments, the cap or cover 240 detachably attaches over the support structure 110 via threads, a snap-fit connection including one or more recesses disposed on the support structure, a snap-fit connection including one or more protrusions extending from the support structure, a bayonet slot and pin (push and turn) connection, or combinations thereof.

FIGS. 3A and 3B also illustrate an embodiment of a valve 250 including a valve shaft 252, an actuator portion 254, and a spring 260. Although several embodiments of valves (250, 350, 450, 550) are fully described hereinbelow, in reality the valve (250, 350, 450, 550) can have any suitable structure for being operable by a user from outside the support structure 110 and for opening and sealing the longitudinal passage 190.

In an embodiment the pad holder ring 230 detachably attaches to the support structure 110 to secure the applicator pad 220 over the convex surface 140 of the support structure 110. This detachable attachment allows the applicator pad 220 to be removed and replaced with each use. In an embodiment the applicator pad 220 is therefore disposable. In an embodiment the applicator pad 220 detachably attaches to the convex surface 140 of the support structure 110 via a hook and loop attachment, wherein for example, a facing surface of the applicator pad 220 has either hooks or loops and the convex surface 140 has the complementary structure, loops or hooks, respectively. The applicator pad 220 can also attach to the convex surface 140 via an adhesive or via other mechanisms for attachment as are known in the art.

Figure 3D:
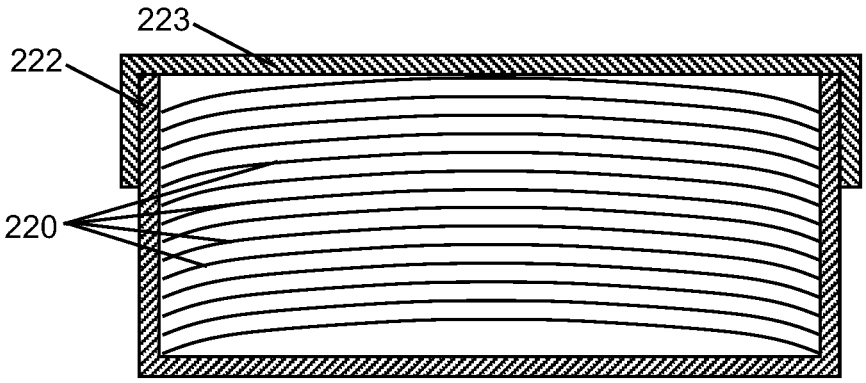
FIG. 3D illustrates a box for containing a plurality of applicator pads according to an embodiment.

It is envisioned that a plurality of applicator pads 220 could be provided with the applicator 100 or separately so that a user wanting to apply the contents of the container 115 would always have a fresh and sanitary applicator pad 220 available for use. For example, referring to FIG. 3D, in an embodiment a kit for the applicator 100 contains the applicator 100, a plurality of additional applicator pads 220, and a storage case or box 222 for storing the plurality of additional applicator pads 220 therein. The box 222 includes a lid 223 that can detachably attach to close the box 222 by any suitable mechanism of attachment as is known in the art.

In an embodiment the applicator pad 220 is made of a porous material through which the flowable contents of the container 115 may pass for application by a user, for example without limitation, the porous material can be a fabric, a foam, a sponge, or the like. In an embodiment the applicator pad 220 can be made from silicone or plastic having a plurality of ports disposed therethrough. In an embodiment the applicator pad 220, regardless of the material from which it is made, can be smooth and/or can include exfoliating bumps 222 (see FIG. 3B) and/or linear or curvilinear ridges 224 (see FIG. 3A).

Referring again to FIG. 2, in an embodiment the support structure 190 includes a valve tube 270 disposed through one of the one or more lateral surfaces 150. The valve tube 270 intersects with the longitudinal passage 190 and has a longitudinal cross-section that extends laterally beyond the longitudinal passage 190. This geometry assures that blockage of the valve tube 270 (for example, by a portion of a valve shaft 252, 352, 452, 552) along the longitudinal axis 120 also blocks the longitudinal passage 190.

Figure 4:
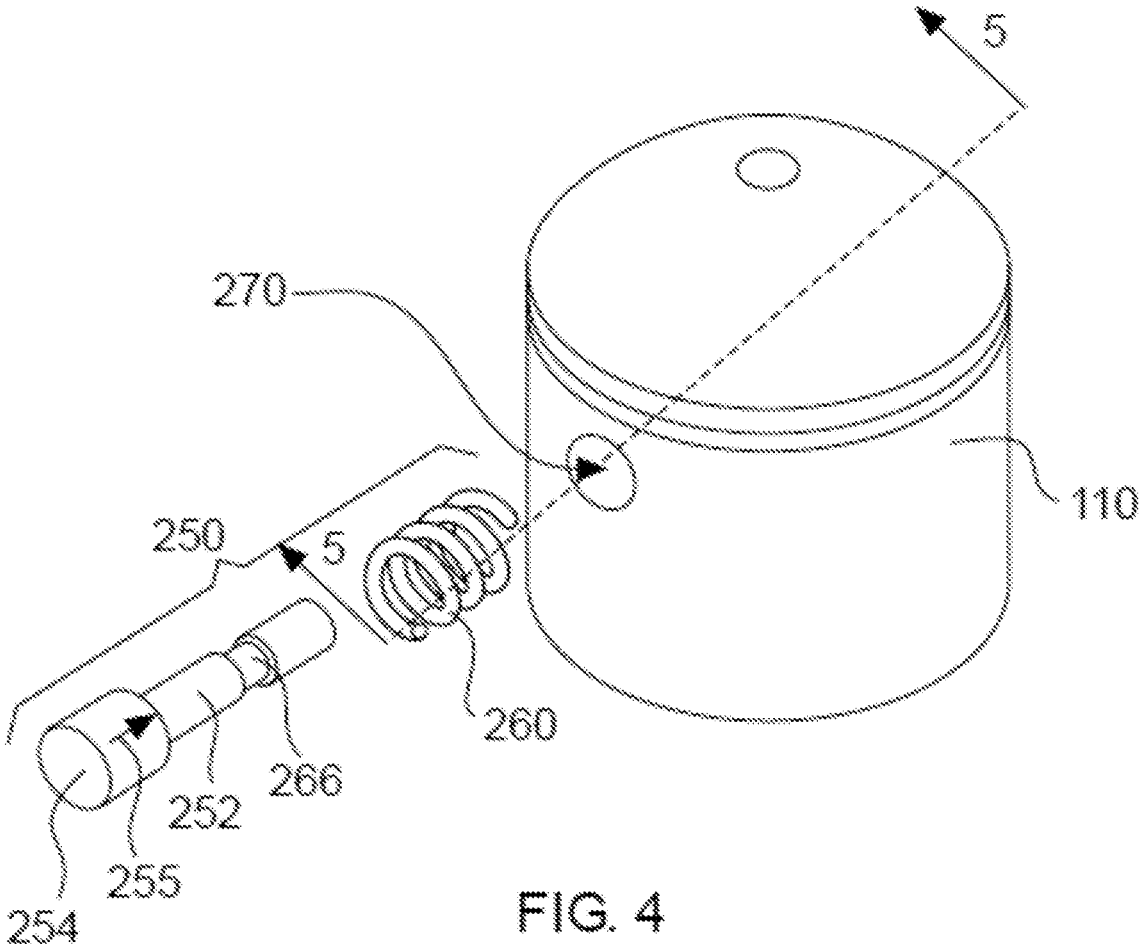
FIG. 4 is a perspective view of a support structure and a valve according to an embodiment.
Figure 5:
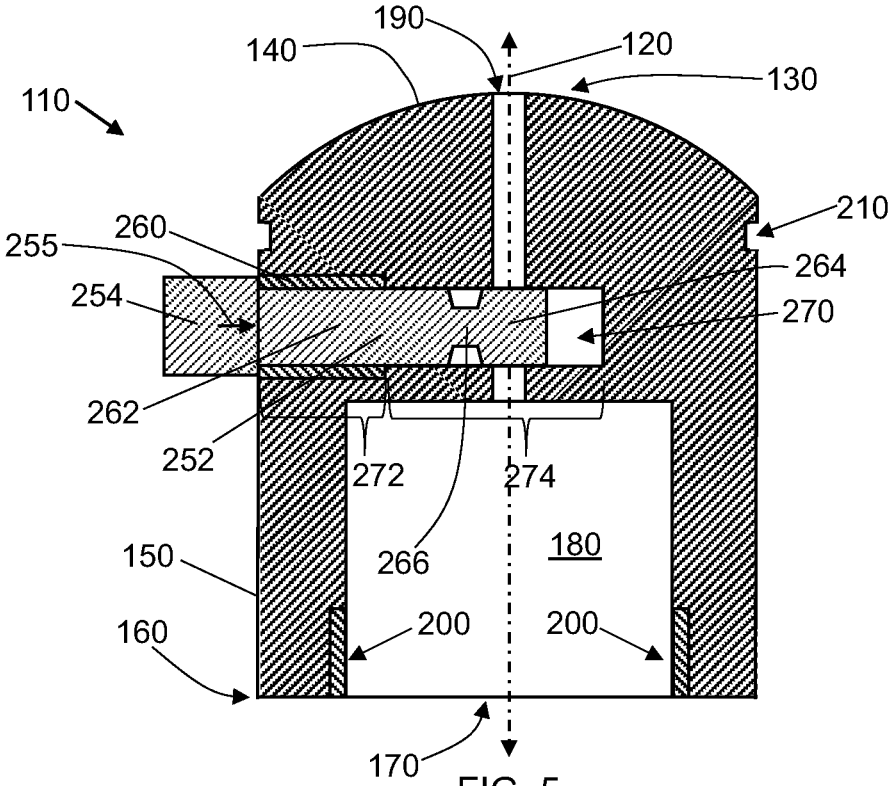
FIG. 5 is a cross-sectional view taken generally along the lines 5-5 in FIG. 4.

Referring to FIGS. 4 and 5, in an embodiment the valve 250, for example, a pushbutton valve 250, includes a valve shaft 252 disposed within the valve tube 270, the valve shaft 252 connected to an actuator portion 254 that extends outside of the valve tube 270 beyond the one or more lateral surfaces 150. In an embodiment the actuator portion 254 includes a position indicator 255 that is indicative of whether the valve 250 is in an open or closed position. The position indicator 255 in an embodiment, for example without limitation, is an arrow or other marking that is visible on the actuator portion 254 when the valve 250 is closed (as shown in FIG. 5) but that is not visible when the valve 250 is open, which as will be seen is when the actuator portion 254 is at least partially pushed into the support structure 190.

Referring in particular to FIG. 5, the valve tube 270 further comprises a non-sealing portion 272 proximate the one of the one or more lateral surfaces 150. A sealing portion 274 extends from an innermost portion of the non-sealing portion 272 beyond a side of the longitudinal passage 190 opposite the non-sealing portion 272. The sealing portion 274 has a longitudinal cross-section that is smaller than the longitudinal cross-section of the non-sealing portion 272. In this embodiment, the applicator 100 further comprises the spring 260 disposed within the non-sealing portion 272 of the valve tube 270.

Still referring to FIG. 5, the valve shaft 252 comprises first and second portions 262, 264 that when disposed within the valve tube 270 form a seal with the sealing portion 274 of the valve tube 270, and a third portion 266 disposed between the first and second portions 262, 264 that when disposed within the valve tube 270 has a longitudinal cross-section that is smaller than the longitudinal cross-section of the sealing portion 274 of the valve tube 270. In this embodiment the valve 250 has a closed configuration as shown in FIG. 5 wherein the valve shaft 252 is biased by the spring 260 so that the third portion 266 does not longitudinally overlap with the longitudinal passage 190. When a force is applied to the actuator portion 254 against the bias of the spring 260, the valve shaft 252 can be pushed to the right in FIG. 5. Therefore, the valve 250 has an open configuration wherein the spring 260 is compressed so that the third portion 266 longitudinally overlaps with the longitudinal passage 190.

In an embodiment the spring 260 is made of metal, for example without limitation, stainless steel or aluminum. In another embodiment the spring 260 is made of any of the materials listed hereinabove, for example without limitation, a plastic, which has a natural lubricity and reduced fabrication costs when compared to a metal spring. A plastic spring 260 could also be molded in different colors as desired and further can have excellent corrosion resistance for use with possibly corrosive contents.

Figure 6:
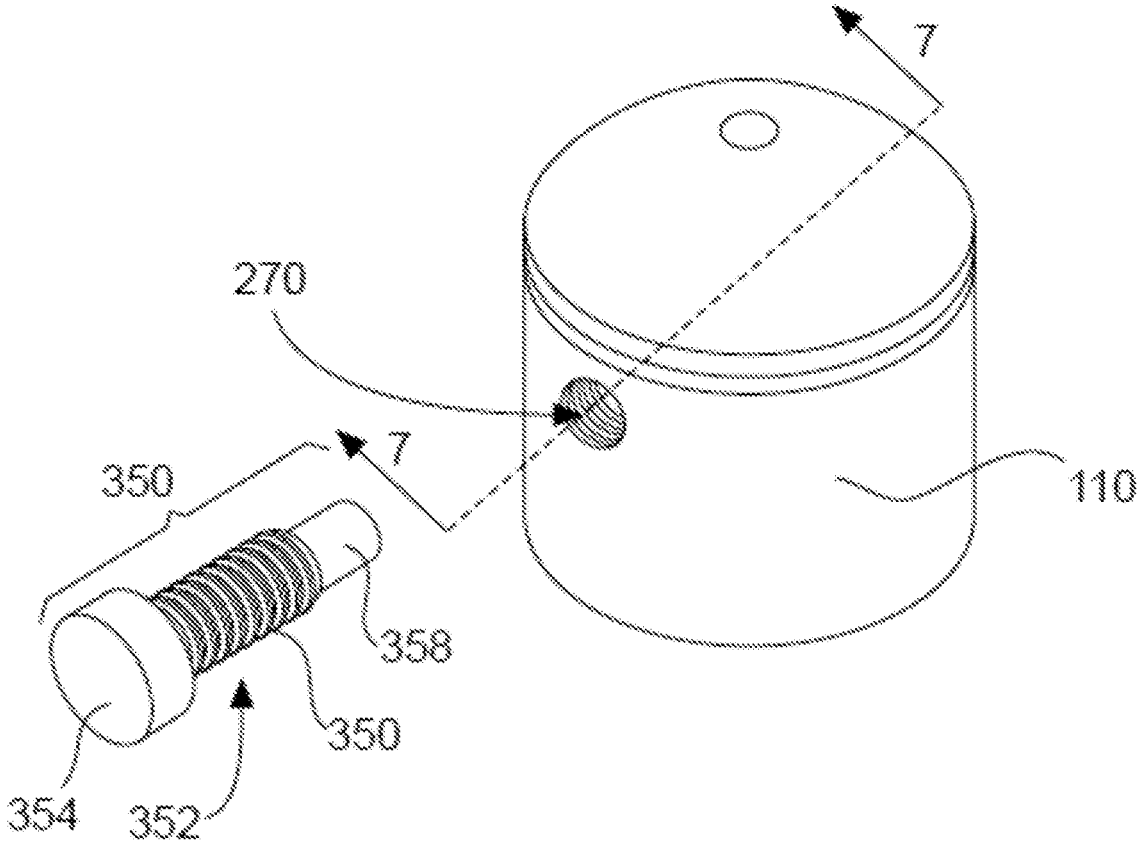
FIG. 6 is a perspective view of a support structure and a valve according to another embodiment.
Figure 7:
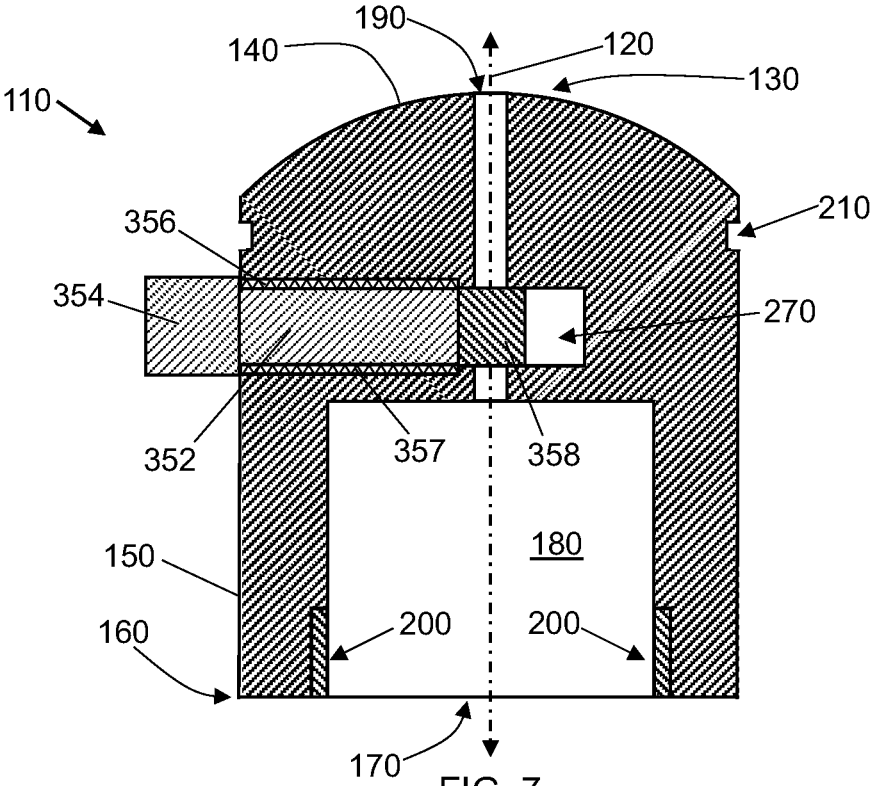
FIG. 7 is a cross-sectional view taken generally along the lines 7-7 in FIG. 6.

Referring to FIGS. 6 and 7, in an embodiment a valve 350 includes a valve shaft 352 disposed within the valve tube 270, the valve shaft 352 connected to an actuator portion 354 that extends outside of the valve tube 270 beyond the one or more lateral surfaces 150. In this embodiment the valve shaft 352 comprises a threaded portion 356 that engages with internal threads 357 that extend part way into the valve tube 270, and a sealing portion 358 extending from an end of the threaded portion 356. In this embodiment the valve 350 has a closed configuration as shown in FIG. 7 wherein the sealing portion 358 extends entirely over the longitudinal passage 190. The valve 350 also has an open configuration achieved by unscrewing the threaded portion 356 part way out of the valve tube 270 until the sealing portion 358 does not extend entirely over the longitudinal passage 190, thereby allowing contents to flow around an end of the valve shaft 352.

Figure 8:
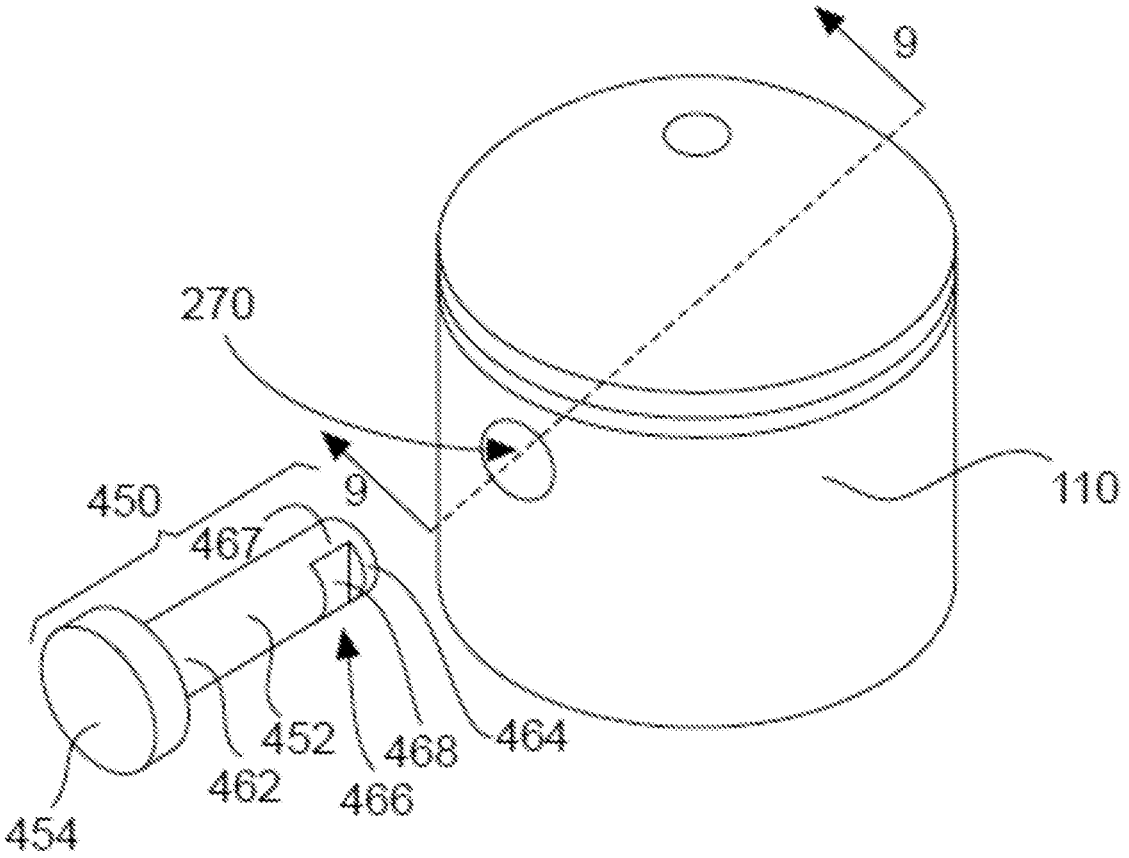
FIG. 8 is a perspective view of a support structure and a valve according to yet another embodiment.
Figure 9:
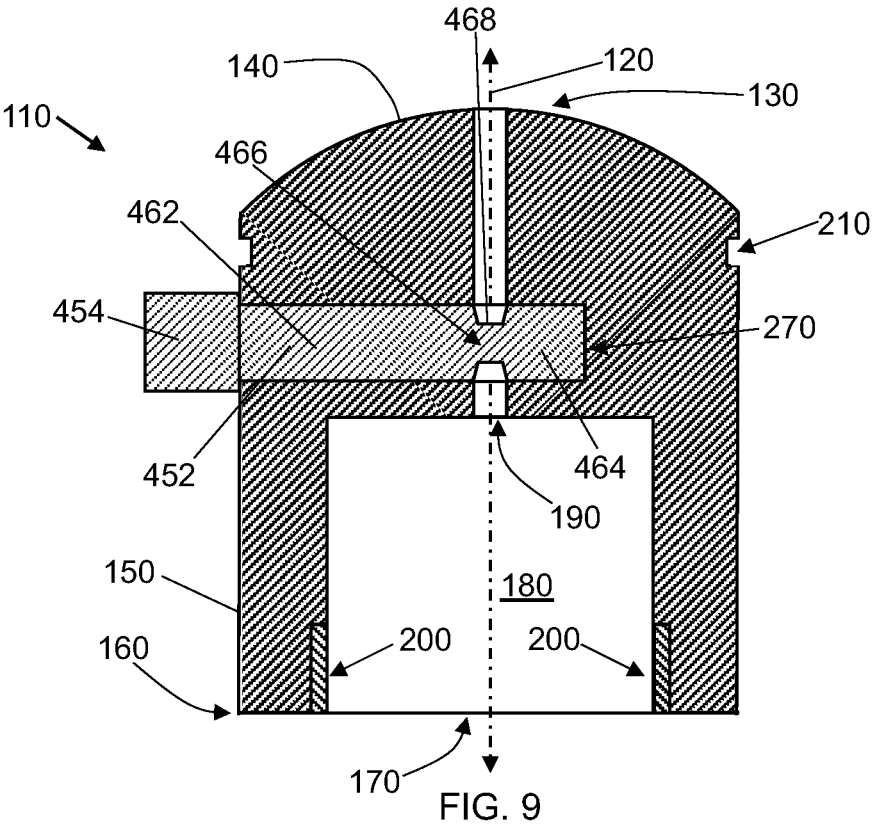
FIG. 9 is a cross-sectional view taken generally along the lines 9-9 in FIG. 8.

Referring to FIGS. 8 and 9, in an embodiment a valve 450, for example, a twist-knob valve 450, includes a valve shaft 452 disposed within the valve tube 270, the valve shaft 452 connected to an actuator portion 454 that extends outside of the valve tube 270 beyond the one or more lateral surfaces 150. In this embodiment first and second portions 462, 464 of the valve shaft 452 when disposed within the valve tube 270 form a seal with the valve tube 270. In this embodiment a third portion 466 of the valve shaft 452 includes an un-recessed surface 467 that when disposed within the valve tube 270 forms a seal with the valve tube 270 and one or more recessed surfaces 468 disposed into the valve shaft 452. In this embodiment the third portion 466 aligns with the longitudinal passage 190 when the valve shaft 452 is disposed within the valve tube 270. In this embodiment the valve 450 has a closed configuration as shown in FIG. 9 wherein the valve shaft 452 is rotationally positioned so that the un-recessed surface 467 of the third portion 466 blocks fluid communication through the longitudinal passage 190. In this embodiment the valve 450 has an open configuration wherein the valve shaft 452 is rotationally positioned so that the un-recessed surface 467 of the third portion 466 does not entirely block fluid communication through the longitudinal passage 190.

Figure 10:
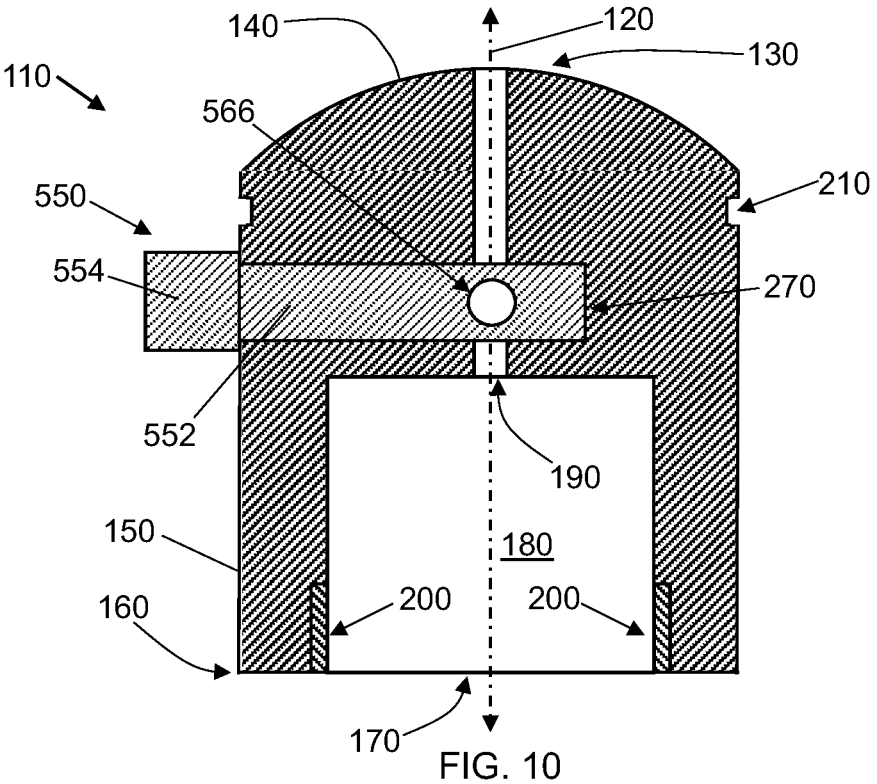
FIG. 10 is a cross-sectional view taken generally along the lines 9-9 in FIG. 8 of yet another embodiment of a support structure and a valve.
Figure 11:
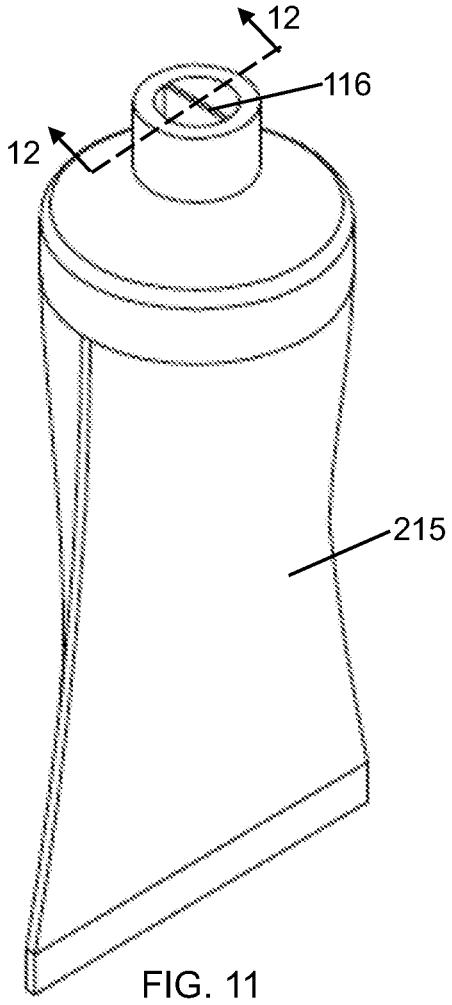
FIG. 11 illustrates an example of a container having two distinct internal volumes for use with an embodiment of an applicator.

Referring to FIG. 10, in an embodiment a valve 550, for example, a twist-knob valve 550, includes a valve shaft 552 disposed within the valve tube 270, the valve shaft 552 connected to an actuator portion 554 that extends outside of the valve tube 270 beyond the one or more lateral surfaces 150. In this embodiment the valve shaft 552 includes a hole 566 disposed entirely therethrough so that the valve 550 has a closed configuration as shown in FIG. 10 wherein the valve shaft 552 is rotationally positioned so that the valve shaft 552 blocks fluid communication through the longitudinal passage 190. In this embodiment the valve 550 has an open configuration wherein the valve shaft 552 is rotationally positioned so that the hole 566 allows fluid communication through the longitudinal passage 190.

Figure 12:
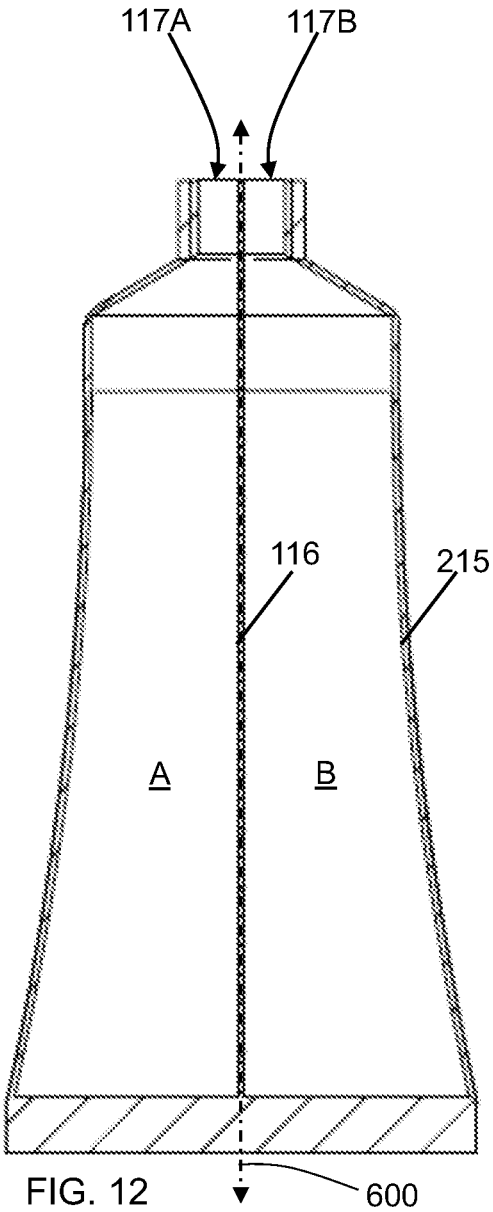
FIG. 12 is a cross-sectional view of the container of FIG. 11 taken generally along the lines 12-12 in FIG. 11.

Referring now to FIGS. 11-14, in an embodiment the applicator 100 can be applied over a container 215 having two or more distinct internal cavities, for example, cavities A and B disposed on opposite sides of an internal divider 116 disposed along a longitudinal axis 600 as illustrated in FIG. 12. In an embodiment such a container having the internal cavities A and B also has an opening 117A into cavity A and an opening 117B into cavity B.

Figure 13:
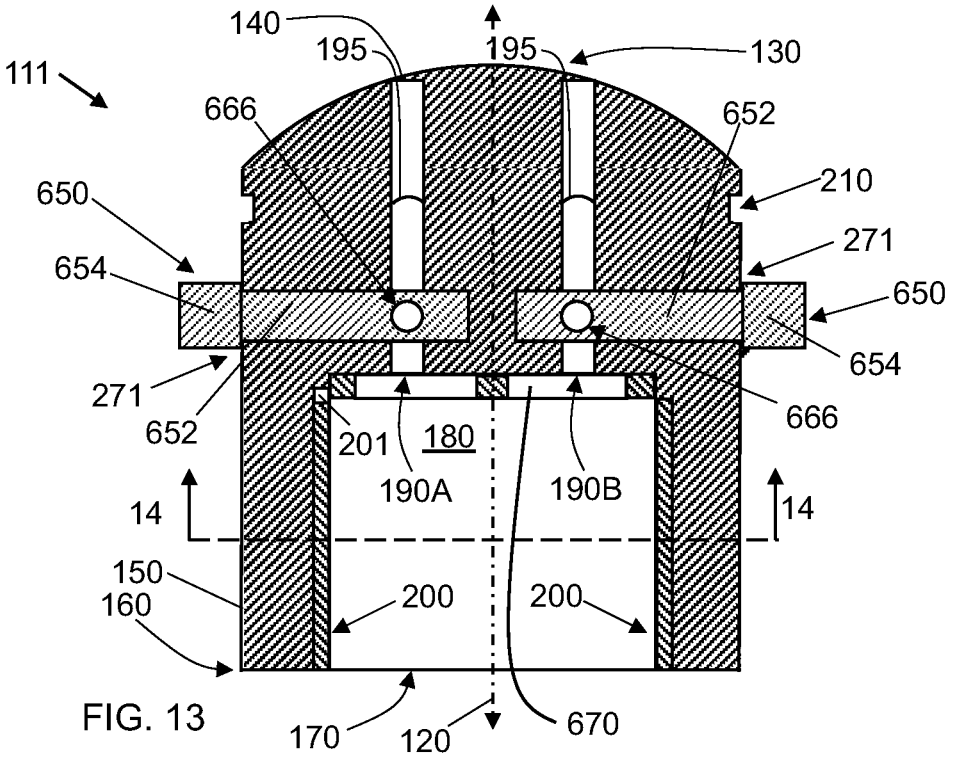
FIG. 13 is a cross-sectional view of an exemplary support structure according to an embodiment and for use with the container of FIG. 11.
Figure 14:
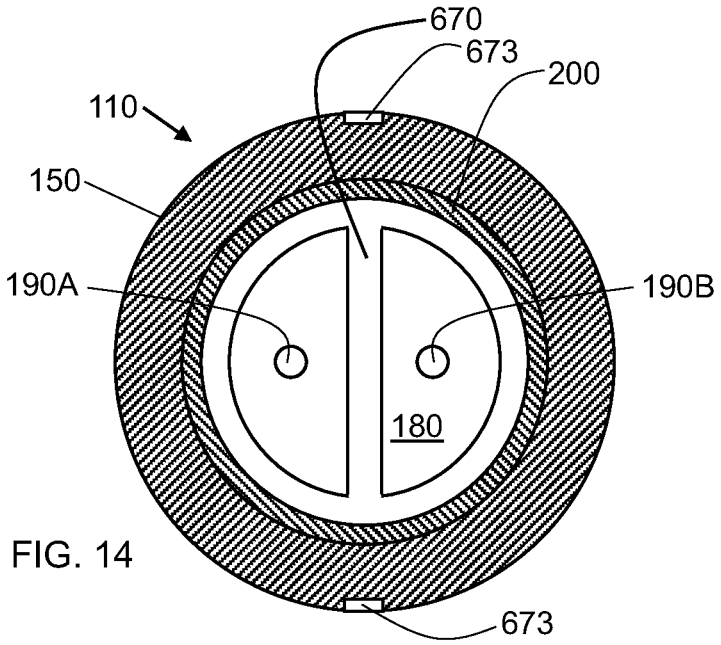
FIG. 14 is a cross-sectional view of the support structure of FIG. 13 taken generally along the lines 14-14 in FIG. 13.

Referring to FIGS. 13 and 14, a support structure 111 in this embodiment includes longitudinal passages 190A and 190B, each having a valve 650 disposed within a valve tube 271 and the one-way valve 195 as described above. In an embodiment each of the valves 650 includes a valve shaft 652 disposed within the valve tube 271, the valve shaft 652 connected to an actuator portion 654 that extends outside of the valve tube 271 beyond the one or more lateral surfaces 150. In this embodiment each valve shaft 652 includes a hole 666. The valves 650 are illustrated to be the same kind of valve as the valve 550 in FIG. 10; however, in another embodiment the valves 650 can be any sort of valve as may be known in the art for opening or blocking fluid communication through the longitudinal passages 190A and 190B, not limited to the valves 250, 350, 450, and 550 also described hereinabove.

Figure 15:
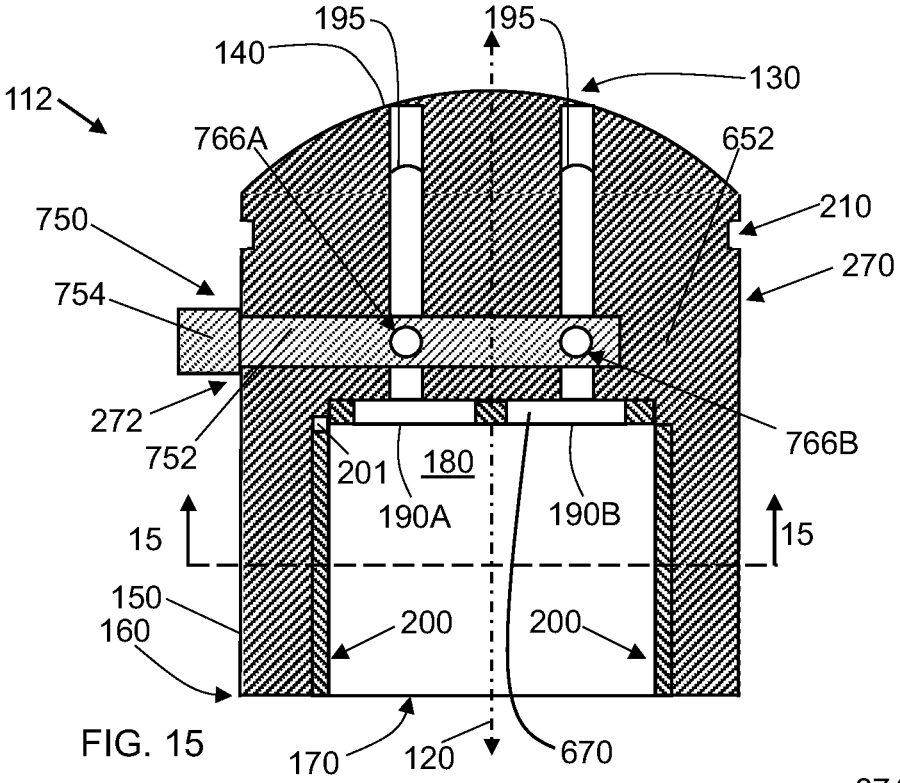
FIG. 15 is a cross-sectional view of an exemplary support structure according to another embodiment and for use with the container of FIG. 11.

In another embodiment the two valves 650 are replaced with a single valve 750 that can operate across both of the longitudinal passages 190A and 190B, either individually controlling fluid communication through each separately or both together. For example, referring to FIG. 15, in an embodiment the support structure 112 includes a single valve tube 272, and the valve 750 includes a valve shaft 752 disposed within the valve tube 272. The valve 750 includes the valve shaft 752 connected to an actuator portion 754 that extends outside of the valve tube 272 beyond the one or more lateral surfaces 150. The valve 750 illustrated in FIG. 15 further includes a first through hole 766A aligned with the longitudinal passage 190A and a second through hole 766B aligned with the longitudinal passage 190B. Therefore, in this embodiment the valve 750 upon being rotated controls the flow through both of the longitudinal passages 190A and 190B simultaneously.

To assure a seal is maintained between the cavities A and B, in this embodiment a sealing ring or gasket 670 is included having a structure that matches an open end of the container 215. In an embodiment the gasket 670 is attached inside the internal cavity 180 as illustrated so that when the applicator 100 is detachably attached to the container 215 the structure of the gasket 670 is aligned with and makes contact with the outer walls and the internal divider 116 of the cavities A and B as is further described hereinbelow. Upon attachment of the applicator 100 to the container 215, the gasket 670 is compressed between the support structure 111, 112 and the container 215 to form a seal. In another embodiment, the gasket 670 can be attached over an end of the container 215 so that the structure of the gasket 670 lines up with the outer walls and the internal divider 116 of the cavities A and B before the support structure 111, 112 is detachably attached to the container 215.

Figure 16:
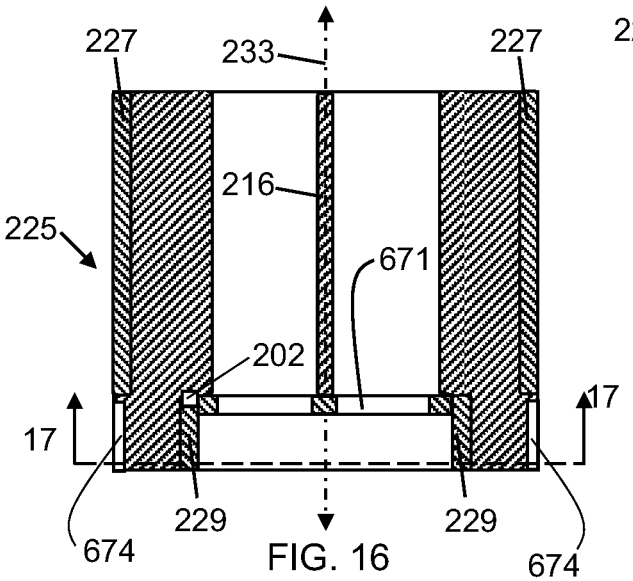
FIG. 16 is a cross-sectional view of an exemplary adapter suitable for use with the container of FIG. 11 according to another embodiment.
Figure 17:
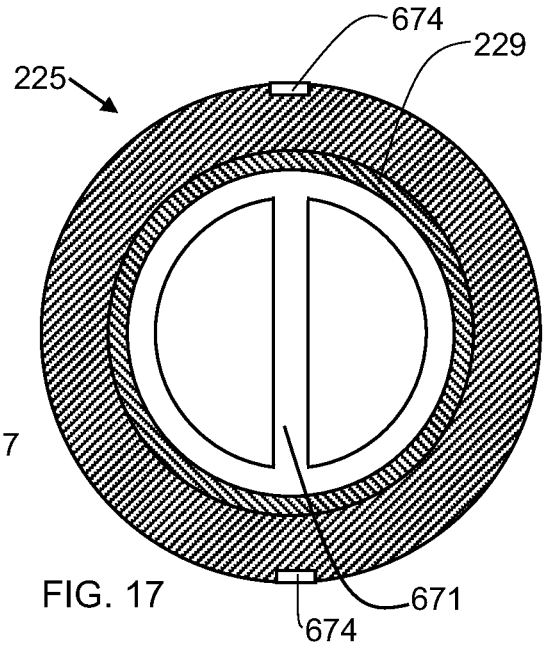
FIG. 17 is a cross-sectional view of the adapter of FIG. 16 taken generally along the lines 17-17 in FIG. 16.

In another embodiment, the support structure 111, 112 is adapted to attach to the container 215 via an adapter 225. The adapter 225 can be sized to fit on any sized container 215. In an embodiment the adapter 225 can comprise a set of different sized adapters 225 to allow the applicator 100 to be detachably connectable to a container 215 having any sized opening 117. For alignment and sealing purposes as explained hereinbelow, in an embodiment the adapter 225 has an internal cross-sectional structure, as shown in FIGS. 16 and 17, that matches the open end of the container 215 and the gasket 670. In an embodiment the adapter 225 includes an internal divider 216 and an adapter gasket 671. In an embodiment the adapter gasket 671 is attached inside the adapter 225 as illustrated so that when the adapter 225 is detachably attached to the container 215 the structure of the adapter gasket 671 is aligned with and makes contact with the outer walls and the internal divider 116 of the cavities A and B. Upon attachment of the adapter 225 to the container 215, the adapter gasket 671 is compressed between the adapter 225 and the container 215 to form a seal. In another embodiment, the adapter gasket 671 can be attached over an end of the container 215 so that the structure of the adapter gasket 671 lines up with the outer walls and the internal divider 116 of the cavities A and B before the adapter 225 is detachably attached to the container 215.

In an embodiment the adapter 225 has a longitudinal axis 233, which aligns with the longitudinal axis 120 when the support structure 111, 112 is attached to the adapter 225. For example without limitation, in an embodiment threads 227 schematically illustrated on the adapter 225 in FIG. 16 cooperate with threads 200 on the support structure 111, 112 to detachably attach the adapter 225 to the support structure 111, 112. In turn, in an embodiment the adapter 225 includes threads 229 that detachably attach the adapter 225 to the container 215.

In other embodiments the support structure 111, 112 attaches to the adapter 225 and the adapter 225 attaches to the container 215 via a snap-fit connection including one or more recesses disposed on the support structure 111, 112 or the adapter 225, a snap-fit connection including one or more protrusions extending from the support structure 111, 112 or the adapter 225, a press-fit, a bayonet slot and pin (push and turn) connection, and combinations thereof, or by other mechanisms for attachment as are known in the art.

To assure that the gasket 670 properly aligns with the internal divider 116 to prevent premature or undesirable mixing of the contents of the cavities, for example, A and B, in an embodiment the support structure 111, 112 includes an alignment feature. Similarly, the adapter 225 also includes an alignment feature to assure proper alignment of the internal divider 216 with the gasket 670 as well as alignment of the adapter gasket 671 with the internal divider 116. The alignment feature can be different in different embodiments and can further be dependent upon the type of attachment mechanism being utilized between components.

For example without limitation, in an embodiment where the attachment mechanism of the support structure 111, 112 is a snap-fit or press fit directly to the container 215, the alignment feature 673 comprises a ridge, groove, visible marking, or other visible structure 673 disposed on the one or more lateral surfaces 150 (see FIG. 14). In use, the alignment feature 673 would be lined up with a corresponding feature of the container 215 or alternatively with a side or edge of the container so that the alignment of the gasket 670 matches the alignment of the internal divider 116. In an embodiment where the attachment mechanism of the support structure 111, 112 is a bayonet slot and pin (push and turn) connection directly to the container 215, the alignment feature is incorporated into the attachment mechanism by positioning the bayonet slot and pin (push and turn) connection such that attachment of the support structure 111, 112 automatically results in an alignment of the gasket 670 with the internal divider 116. In an embodiment where the attachment mechanism of the support structure 111, 112 is a threaded connection directly to the container 215, the alignment feature is a stop or restriction 201 (see FIGS. 13 and 15) incorporated directly into an end of travel of the threads 200 and disposed in a position relative to the gasket 670 such that that a fully threaded attachment of the support structure 111, 112 limited by the stop 201 automatically results in an alignment of the gasket 670 with the internal divider 116.

In an embodiment where the attachment mechanism of the support structure 111, 112 is a snap-fit or press fit via the adapter 225 to the container 215, the alignment feature 673 again comprises a ridge, groove, visible marking, or other visible structure 673 disposed on the one or more lateral surfaces 150 (see FIG. 14) that is lined up with a corresponding alignment feature 674 (which is schematically shown in FIG. 16 rotated by 90 degrees around the adapter 225 relative to FIG. 17 to make it visible) having the same or similar structure as alignment feature 673. In use, the alignment feature 673 would be lined up with the alignment feature 674 upon connection of the support structure 111, 112 to the adapter 225, and the alignment feature 674 would be lined up to a corresponding feature of the container 215 or alternatively with a side or edge of the container so that the alignment of the gasket 670 matches the alignment of the internal divider 216 and the alignment of the adapter gasket 671 matches the alignment of the internal divider 116.

In an embodiment where the attachment mechanism of the support structure 111, 112 is a bayonet slot and pin (push and turn) connection via the adapter 225 to the container 215, the alignment features are incorporated into the attachment mechanisms by positioning the bayonet slot and pin (push and turn) connection such that attachment of the support structure 111, 112 automatically results in an alignment of the gasket 670 with the internal divider 216 and such that attachment of the adapter 225 automatically results in an alignment of the adapter gasket 671 with the internal divider 116. In an embodiment where the attachment mechanism of the support structure 111, 112 is a threaded connection via the adapter 225 to the container 215, the alignment features are a stop or restriction 201 (see FIGS. 13 and 15) on the support structure 111, 112 and a stop or restriction 202 (see FIG. 16) on the adapter 225, each incorporated directly into an end of travel of the threads 200 and 229, respectively. The stop 201 is disposed in a position relative to the gasket 670 such that that a fully threaded attachment of the support structure 111, 112 limited by the stop 201 automatically results in an alignment of the gasket 670 with the internal divider 216. Likewise, the stop 202 is disposed in a position relative to the gasket 671 such that that a fully threaded attachment of the support structure 111, 112 limited by the stop 202 automatically results in an alignment of the adapter gasket 671 with the internal divider 116. In embodiments wherein the mechanism for connection of the support structure 111, 112 to the adapter 225 is different than the mechanism for connection of the adapter 225 to the container 215, each connection is aligned as described above for the particular type of connection used to assure a seal of the internal cavities A and B. In other embodiments, other suitable mechanisms for alignment of the internal sealing structures within the support structure 111, 112, the adapter 225, and the container 215 are utilized as are known in the art.

In other embodiments the container 215 has three, four, or more distinct internal cavities separated by multiple internal dividers 116 and a corresponding support structure 111, 112 for detachable attachment thereto includes a corresponding number of longitudinal passages, valves, and a gasket 670 shaped to align with and seal against the multiple internal dividers 116 and outer walls of the distinct internal cavities, and a corresponding adapter 225 for detachable attachment therebetween includes an adapter gasket 671 shaped to align with and seal against the multiple internal dividers 116 and outer walls of the distinct internal cavities.

Numerous modifications to the present invention will be apparent to those skilled in the art in view of the foregoing description. It is not desired to limit the invention to the exact construction and operation shown and described, and accordingly, all suitable modifications and equivalents may be resorted to, falling within the scope of the invention. Accordingly, this description is to be construed as illustrative only of the principles of the invention and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

INDUSTRIAL APPLICABILITY

An applicator for a container includes a support structure having a convex surface for the detachable attachment of a disposable applicator pad. The applicator includes a user selectable sealing valve and can be sold with a plurality of additional applicator pads for quick and convenient replacement by a user. The applicator can be made in industry for use by consumers.

Numerous modifications to the present invention will be apparent to those skilled in the art in view of the foregoing description. It is not desired to limit the invention to the exact construction and operation shown and described, and accordingly, all suitable modifications and equivalents may be resorted to, falling within the scope of the invention. Accordingly, this description is to be construed as illustrative only of the principles of the invention and is presented for the purpose of enabling those skilled in the art to make and use the invention and to teach the best mode of carrying out same. The exclusive rights to all modifications which come within the scope of the appended claims are reserved. All patents, patent publications and applications, and other references cited herein are incorporated by reference herein in their entirety.

I claim:

1. An applicator for a container, the applicator comprising:

a support structure, comprising:

a first end having a convex surface, and one or more lateral surfaces extending away from the first end;

a second end opposite to the first end and having an opening into an internal cavity;

a longitudinal passage providing fluid communication between the first end and the internal cavity;

wherein the support structure is adapted to detachably attach to a container at the second end;

wherein the support structure is adapted to detachably attach an applicator pad to the convex surface; and further comprising a user selectable valve disposed across the longitudinal passage;

wherein the user selectable valve is selected from the group of valves consisting of: a spring-loaded push-button valve, a threaded valve, and a twist-knob valve; and wherein the user selectable valve has a closed and sealed configuration and an open configuration.

2. The applicator of claim 1 further comprising the applicator pad, wherein the applicator pad comprises an application surface facing away from the convex surface, wherein the application surface has a surface texture selected from the group consisting of: a smooth surface, bumps, ridges, and combinations thereof.

3. The applicator of claim 1 further comprising the applicator pad, wherein the applicator pad detachably attaches to the convex surface via a hook and loop attachment.

4. The applicator of claim 1, wherein the support structure is further adapted to detachably attach an applicator pad holder ring to the one or more lateral surfaces proximate to the first end.

5. The applicator of claim 4, wherein the support structure is adapted to detachably attach the applicator pad holder ring the one or more lateral surfaces proximate to the first end by an attachment mechanism selected from the group consisting of: threads, a snap-fit connection including one or more recesses disposed on the support structure, a snap-fit connection including one or more protrusions extending from the support structure, a press-fit, a bayonet slot and pin connection, and combinations thereof.

6. The applicator of claim 1, wherein the support structure is adapted to detachably attach to the container at the second end by an attachment mechanism selected from the group consisting of: threads, a snap-fit connection including one or more recesses disposed on the support structure, a snap-fit connection including one or more protrusions extending from the support structure, a press-fit, a bayonet slot and pin connection, and combinations thereof.

7. The applicator of claim 1, wherein the support structure is adapted to detachably attach to the container at the second end via an adapter, wherein detachable attachment of the support structure to the adapter is by an attachment mechanism selected from the group consisting of: threads, a snap-fit connection including one or more recesses disposed on the support structure, a snap-fit connection including one or more protrusions extending from the support structure, a press-fit, a bayonet slot and pin connection, and combinations thereof, and wherein detachable attachment of the adapter to the container is by an attachment mechanism selected from the group consisting of: threads, a snap-fit connection including one or more recesses disposed on the support structure, a snap-fit connection including one or more protrusions extending from the support structure, a press-fit, a bayonet slot and pin connection, and combinations thereof.

8. The applicator of claim 1, further comprising a cover that attaches to the support structure over the applicator pad holder ring.

9. The applicator of claim 1, wherein the longitudinal passage includes a one-way valve allowing flow through the longitudinal passage from the second end toward the first end.

10. The applicator of claim 1, wherein at least a portion of the applicator is made from or coated with anti-microbial materials.

11. The applicator of claim 1 further comprising:

the applicator pad; and an applicator pad holder ring;

wherein the applicator pad holder ring detachably attaches the applicator pad over the convex surface on the first end of the support structure.

12. The applicator of claim 11, wherein detachable attachment of the applicator pad holder ring to the support structure is by an attachment mechanism selected from the group consisting of: a snap-fit connection including one or more protrusions extending from the support structure, a snap-fit connection including one or more grooves extending into the support structure, a press-fit, a bayonet slot and pin connection, threads, and combinations thereof.

13. An applicator for a container, the applicator comprising:

a support structure, comprising:

a first end having a convex surface, and one or more lateral surfaces extending away from the first end;

a second end opposite to the first end and having two or more openings into an internal cavity;

two or more longitudinal passages providing fluid communication between the first end and the internal cavity;

wherein the support structure is adapted to detachably attach at the second end to a container having two or more distinct openings, so that when detachably attached each of the two or more longitudinal passages is in sealed fluid communication with one of the two or more distinct openings; and wherein the support structure is adapted to detachably attach an applicator pad to the convex surface.

14. The applicator of claim 13, further comprising at least one user selectable valve disposed across the two or more longitudinal passages, wherein the at least one user selectable valve has a closed and sealed configuration and an open configuration.

15. The applicator of claim 14, wherein the at least one user selectable valve comprises a user selectable valve disposed across each of the two or more longitudinal passages, wherein each user selectable valve has a closed and sealed configuration and an open configuration.

16. The applicator of claim 15, wherein each of the user selectable valves is selected from the group of valves consisting of: a spring-loaded pushbutton valve, a threaded valve, and a twist-knob valve.

17. The applicator of claim 14 further comprising:

the applicator pad; and an applicator pad holder ring;

wherein the applicator pad holder ring detachably attaches the applicator pad over the convex surface on the first end of the support structure.

18. The applicator of claim 14, wherein the at least one user selectable valve is selected from the group of valves consisting of: a spring-loaded pushbutton valve, a threaded valve, and a twist-knob valve.

19. The applicator of claim 13, wherein the support structure further comprises a gasket attached within the internal cavity and shaped to form a seal against surfaces of the container that define the two or more distinct openings when the support structure is detachably attached to the container.

20. The applicator of claim 19, further comprising:

a plurality of additional applicator pads; and a storage case for the plurality of additional applicator pads.

* * * * *